US006767242B2

(12) United States Patent
Feller et al.

(10) Patent No.: US 6,767,242 B2
(45) Date of Patent: Jul. 27, 2004

(54) TERMINAL COVERING CAP FOR CONNECTION TERMINALS OF A MULTI-PHASE ELECTRICAL SWITCHING DEVICE

(76) Inventors: Willy Feller, Sommattstrasse 16, Rombach (CH), 5022; Patrik Kalt, Staffeleggstrasse 7, Schonenwerd (CH), 5012; Hans-Jurgen Haars, Bucheggweg 15, Unterentfelden (CH), 5035; Hans Weichert, Unterfeldstrasse 41, Granichen (CH), 5722; Sandro Liberto, Girixwag 9, Aarau (CH), 5001

( * ) Notice: Subject to any disclaimer, the term of this patent is extended or adjusted under 35 U.S.C. 154(b) by 38 days.

(21) Appl. No.: 10/242,501

(22) Filed: Sep. 12, 2002

(65) Prior Publication Data

US 2003/0068923 A1 Apr. 10, 2003

(30) Foreign Application Priority Data

Sep. 24, 2001 (CH) ..... 1759/01

(51) Int. Cl.[7] ..... H01R 13/52
(52) U.S. Cl. ..... 439/521
(58) Field of Search ..... 439/521, 367, 439/810, 901, 701

(56) References Cited

U.S. PATENT DOCUMENTS 6,238,234 B1 * 5/2001 Sedlecky ..... 439/412
6,325,675 B1 * 12/2001 Harmeyer ..... 439/709
6,371,795 B1 * 4/2002 Yamamoto et al. ..... 439/468

FOREIGN PATENT DOCUMENTS

DE 3608535 C1 * 5/1987
WO WO 94/13032 * 6/1994

* cited by examiner

*Primary Examiner*—Tho D. Ta
(74) *Attorney, Agent, or Firm*—Quarles & Brady, LLP; Alexander M. Gerasimow

(57) ABSTRACT

A terminal covering cap is mounted over the connection terminals of a multi-phase electrical switching device in order to increase the electric strength between the connection terminals of neighbouring phases. The L-shaped terminal covering cap closely abuts on its side facing the insulating housing the marginal region of connection openings leading to the connection terminals, with a negligible air gap. With this barrier, the required increased test voltage between the connection terminals can be withstood. On the side facing away from the insulating housing, the terminal covering cap is provided with ribs, to extend the creep distance on this side of the terminal covering cap. The terminal covering cap formed in this way makes it possible to carry out testing a the prescribed, increased test voltage without enlarging the insulating housing in order to extend the creep distance between the connection terminals of neighbouring phases.

13 Claims, 2 Drawing Sheets

TERMINAL COVERING CAP FOR CONNECTION TERMINALS OF A MULTI-PHASE ELECTRICAL SWITCHING DEVICE

CROSS-REFERENCE TO RELATED APPLICATIONS

This application claims priority to Swiss Patent Application No. CH 2001 1759/01, filed on Sep. 24, 2001, the disclosure of which is hereby incorporated by reference as if set forth in its entirety herein.

STATEMENT REGARDING FEDERALLY SPONSORED RESEARCH OR DEVELOPMENT

BACKGROUND OF THE INVENTION

The present invention relates to a terminal covering cap for the connection terminals of a multi-phase electrical switching device with electrical connection terminals which are accommodated in an insulating housing of the switching device shared by all the phases and are equipped with clamping screws which serve for fastening electrical lines in the connection terminals, are perpendicular to the lines and are accessible from the surface of the insulating housing via recesses.

EP-A1-0051755 discloses a covering device for protecting connection terminals of electrical installation units. The covering device is approximately L-shaped in cross section. This covering device is held on the installation unit by at least one resilient lug gripping behind projections or recesses on the installation unit. This covering device serves as protection of the connection terminals against incidental contact and does not increase the electric or dielectric strength, also called "voltage strength", between the connection terminals of neighbouring phases of the installation unit.

BRIEF SUMMARY OF THE INVENTION

An object of the present invention is to provide a terminal covering cap for the connection terminals of a multi-phase electrical switching device which has the effect of increasing the electric strength between the connection terminals of neighbouring phases of the switching device and thus meets the requirements of various standards, for example the US standard UL508, with respect to the electric strength between neighbouring connection terminals of an electrical switching device, and is commercially advantageous.

The set object is achieved by providing, to ensure the electric strength between the connection terminals of neighbouring phases, an L-shaped terminal covering cap, extending with one leg over recesses leading to clamping screws and with the other leg over connection openings leading to the connection terminals. Furthermore, the L-shaped terminal covering cap closely abuts or snugly bears against the insulating housing with a negligable air gap in such a manner that it bears with its side facing the insulating housing in the edge or marginal region of said connection openings leading to the connection terminals snugly against the insulating housing, with a negligable air gap. The terminal covering cap is provided, on its surface facing away from the insulating housing, with projecting ribs between the cap openings which lead to the connection terminals. Said projecting ribs ensure the required creep distance. Various standards request testing of the electric strength between the neighbouring connection terminals of an electrical switching device. In exceptional cases, the creep distance that usually exists on the surface of the insulating material lying between the connection terminals is not sufficient to withstand the prescribed test voltage. The fact that the terminal covering cap bears on its side facing the insulating housing in the marginal region of the connection openings leading to the connection terminals snugly against the insulating housing, with a negligible air gap, has the effect of producing a barrier. Said barrier can withstand a higher test voltage, requested by various regulations, than the same distance without a terminal covering cap in bearing contact or abutting relationship according to the present invention. This measure makes it possible to increase the electric strength between neighbouring connection terminals without the creep distance being extended by enlarging the insulating housing. On the side of the terminal covering cap facing away from the insulating housing, there is sufficient space for providing ribs, so that on this side the creep distance is increased in a manner corresponding to the test voltage by means of said ribs provided between the cap openings leading to the connection terminals.

The terminal covering cap may be undetachably fastened to the finished switching device by snap connections before connecting the electrical lines. Various standards request that the terminal covering cap must be undetachably fastened to the insulating housing. This is achieved by the undetachable snap connections provided in the present invention.

The terminal covering cap advantageously has on its side facing the insulating housing at least one holding extension gripping behind in the insulating housing and at least one snap lug gripping behind a projection of the insulating housing. This arrangement makes said undetachable fastening of the terminal covering cap to the insulating housing possible without a screw connection, which is advantageous in particular in case of relatively small switching devices.

The L-shaped terminal covering cap may be screwed onto the insulating housing in the region of the recesses or openings leading to the connection terminals. The L-shaped terminal covering may be be fastened with the leg that is perpendicular thereto—which means with its other leg that is perpendicular to its screwed leg—to the insulating housing by means of at least one holding stop gripping behind the insulating housing and by means of at least one snap lug engaging a projection of the insulating housing. The snap lug engaging the insulating housing provides said undetachable fastening of the terminal covering cap to the insulating housing.

The terminal covering cap may have separating extensions protruding into the cavity of the recesses leading to the connection terminals of neighbouring phases. The separating extensions extending into the cavity of the recesses which lead to the connection terminals serve as an electrical barrier and increase the limit of a minimum test voltage requested for the switching device.

BRIEF DESCRIPTION OF THE DRAWINGS

The invention is described in more detail below on the basis of the accompanying drawings, in which.

DETAILED DESCRIPTION OF THE PREFERRED EMBODIMENT

Figure 1:
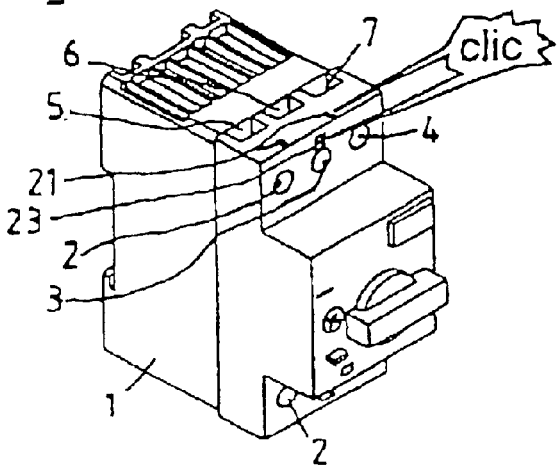
FIG. 1 shows the perspective representation of a relatively small electrical switching device without a terminal covering cap.

In FIG. 1, a relatively small electrical switching device is perspectively shown. The switching device, together with switching contact elements, a contact actuating mechanism and connection terminals, is accommodated in an insulating housing 1 of insulating material. Electrical lines (not shown) can be inserted through connection openings 5, 6, 7 and led to the connection terminals. Clamping screws, which are provided for fastening the electrical lines in the connection terminals and which are perpendicular to the lines, are accessible from the surface of the insulating housing 1 through recesses 2, 3, 4. For various regulations, the creep distance or surface leakage path which exists between the connection terminals on the surface of the insulating material is not sufficient to withstand the test voltage specified in various standards. The terminal covering cap 8 shown in FIGS. 2, 3 and 4 overcomes this disadvantage.

Figure 2:
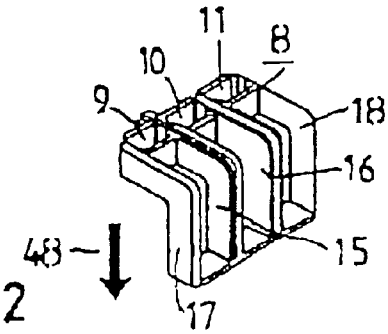
FIG. 2 shows a terminal covering cap matching the said device.
Figure 3:
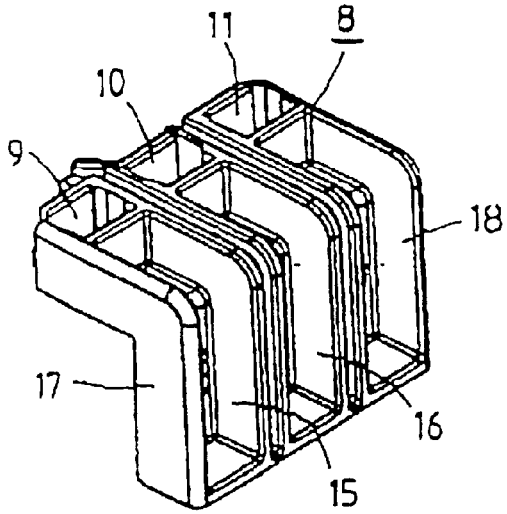
FIG. 3 shows the terminal covering cap shown in FIG. 2 on a different scale, seen from the side facing away from the switching device.

To show details of the manner in which the terminal covering cap 8 is formed, the same terminal covering cap 8 is shown on a different scale in FIGS. 2 and 3. These FIGS. 2 and 3 show the terminal covering cap 8 from the side facing away from the insulating housing 1. The figures clearly show recesses 9, 10, 11 which lead via the above mentioned recesses 5, 6, 7 to the connection terminals (not shown). Furthermore, the figures clearly show multi-layered ribs 15, 16 which are provided between the cap openings 12, 13, 14, which can be seen well in FIG. 4. The two side ribs 17, 18 increase the creep distance to the outer connection terminals of a neighbouring switching device (not shown) and form the lateral termination of the terminal covering cap 8.

Figure 4:
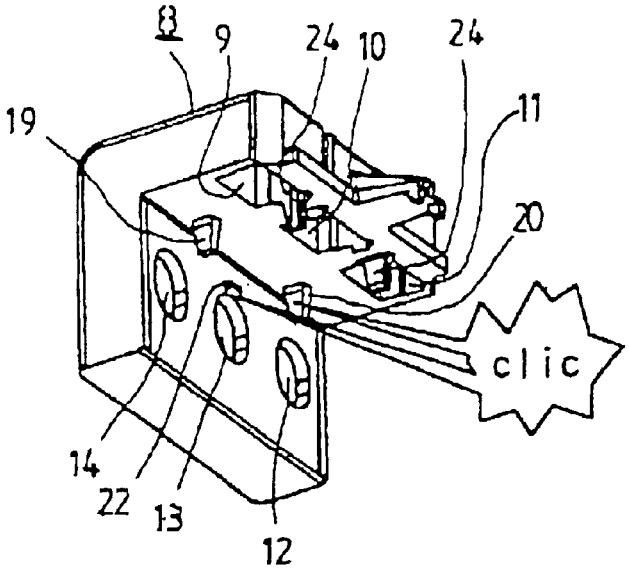
FIG. 4 shows the terminal covering cap seen from the side facing the switching device.

The L-shaped terminal covering cap 8 mounted to the switching device extends with its one leg over the recesses 2, 3, 4 leading to the clamping screws and extends with its other leg over the connection openings 5, 6, 7 leading to the connection terminals. FIG. 4 shows two holding extensions 19, 20, which are inserted into holding openings 21 provided in the insulating housing 1 when the terminal covering cap 8 is mounted on the switching device. At the end of the inserting movement, taking place in the direction of arrow 48, snap lug 22 which can be seen in FIG. 4 engages a projection 23 of the insulating housing 1 which is provided at the end of a slot. Thus, snap lug 22 provides an undetachable connection between the terminal covering cap 8 and the insulating housing 1. This undetachable or locked connection is requested in various standards.

The terminal covering cap 8 bears with the marginal or marginal regions of the cap openings 9, 10, 11 facing the insulating housing 1 snugly against the marginal regions of the terminal openings 5, 6, 7 of the insulating housing 1. These parts of the terminal covering cap 8 bearing snugly or closely abutting around the connection openings 5, 6, 7 demonstrably increase the electric strength between the connection terminals of the electrical device, so that the electric strength required in the various regulations between the connection terminals of an electrical device can be achieved by means of the terminal covering cap 8.

To increase the electric strength between the connection terminals being provided in the insulating housing 1, separating extensions 24 are formed on the terminal covering cap 8. The separating or isolating extensions 24 protrude into the recesses 5, 6, 7 provided in the insulating housing 1 and thus contribute to extend the creep distance. The separating extensions 24 may take various forms and may correspondingly protrude into the recesses 5, 6, 7 only to a part or to full circumferential extent.

Figure 6:
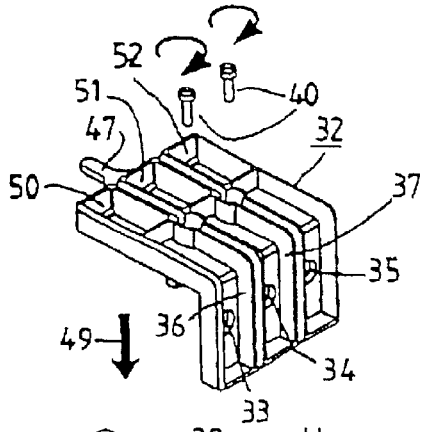
FIG. 6 shows a terminal covering cap for the said device shown in FIG. 5.
Figure 7:
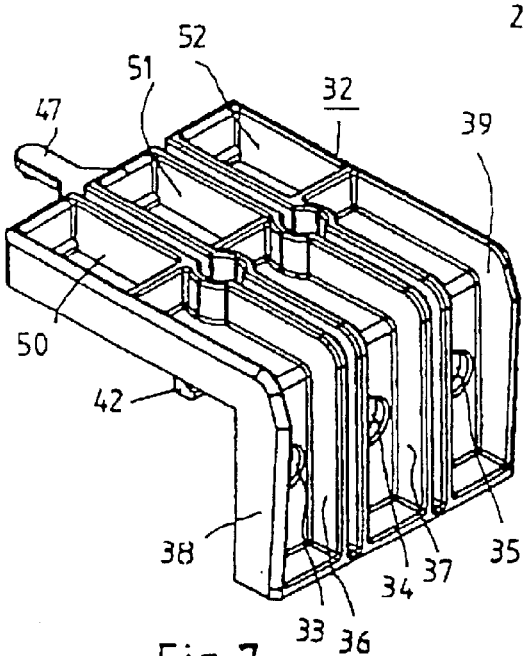
FIG. 7 shows the terminal covering cap shown in FIG. 6 on a different scale, seen from the side facing away from the switching device.
Figure 8:
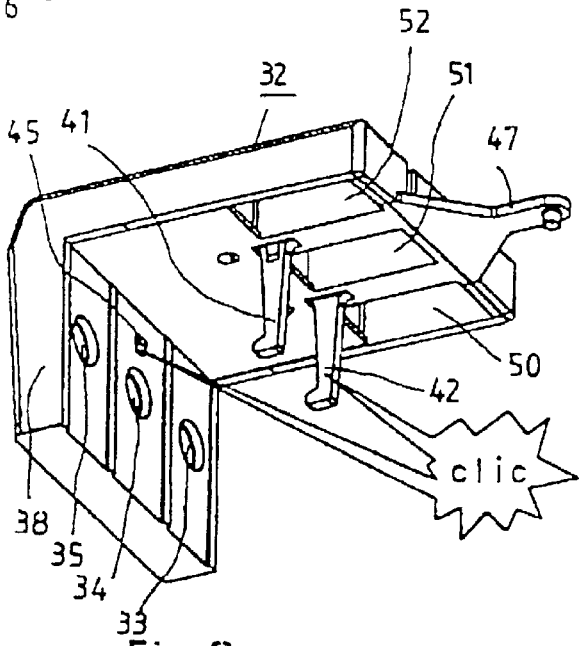
FIG. 8 shows the terminal cap shown in FIG. 7 seen from the side facing the switching device.

The terminal covering cap 32 shown in FIGS. 6, 7 and 8 is provided for a larger switching device. The basic configuration is similar to that previously described for a smaller switching device. The most important difference between the two configurations is that in the case of the configuration of the present embodiment the terminal covering cap 32 is fastened to the insulating housing 25 not only by means of a snap connection but also by a screw connection.

Figure 5:
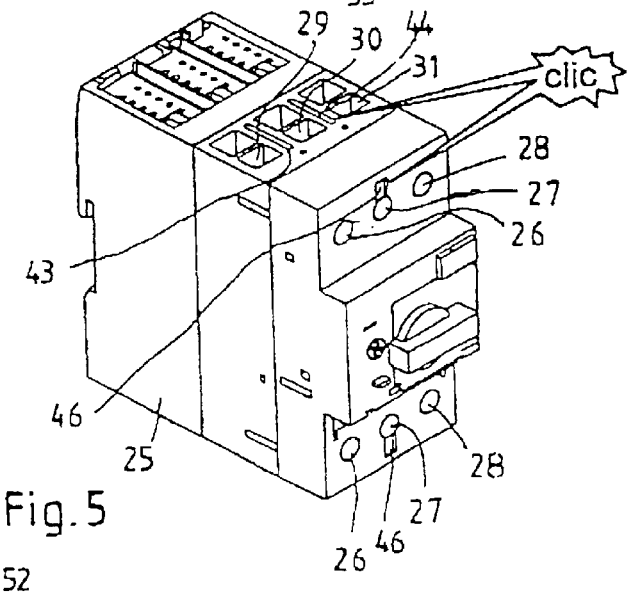
FIG. 5 shows the perspective representation of a relatively large electrical switching device without a terminal covering cap.

The insulating housing 25 shown in FIG. 5 also encloses the switching contact elements, the contact actuating mechanism and the connection terminals. The electrical lines (not shown) are inserted through the connection openings 29, 30, 31 and led to the connection terminals and are securely clamped there by means of clamping screws accessible through recesses 26, 27, 28. In this configuration too, the electric strength between the connection terminals is increased by means of the terminal covering cap 32.

Again there is only a difference of scale between the terminal covering cap 32 shown in FIG. 6 and FIG. 7. FIG. 8 shows terminal covering cap 32 of the present embodiment from the side facing the insulating housing 25. FIG. 8 shows the cap openings 50, 51, 52 serving for leading the electrical lines to the connection terminals. In FIGS. 6 and 7, the terminal covering cap 32 is shown from a side facing away from the insulating housing. FIGS. 6, 7 show projecting ribs 36, 37, which serve for extending or lengthening the creep distance between neighbouring connection terminals and consequently for increasing the electric strength. The lateral terminating ribs 38, 39 can also be seen well.

The L-shaped terminal covering cap 32 mounted to the switching device extends with its one leg over the connection openings 29, 30, 31 which lead to the connection terminals. This leg is screwed onto the insulating housing 25 by means of screws 40 when the terminal covering cap 32 is mounted. This leg carries on its side facing the insulating housing 25 two holding stops 41, 42, which during mounting engage in gaps 43, 44 which are integrally formed in insulating housing 25. The terminal covering cap 32 is mounted after having inserted the holding stops 41, 42 into the gaps 43, 44. When being mounted, the cap is urged in direction of the arrow 49 onto the insulating housing 25 until a snap lug 45 grips behind a projection 46. The snap lug 45 is integrally formed on the inner side of the other leg of the L-shaped terminal covering cap 32. The projection 46 is provided at the end of a slot. This snap connection provides an undetachable connection between the terminal covering cap 32 and the insulating housing 25. The screws 40, which hold the terminal covering cap 32 on the insulating housing 25, serve for securing the terminal covering cap 32.

Again, the marginal regions of the cap openings 50, 51, 52 being provided in the terminal covering cap 32 and facing the insulating housing 25 bear snugly against the marginal regions of the connection openings 29, 30, 31 of the insulating housing 25. The insulating parts bearing snugly or closely abutting against one another increase the electric strength between the connection terminals of the electrical switching device in comparison with the electric strength without a terminal covering cap 32.

An arm 47 of the terminal covering cap 32 is provided with a positioning pin and merely serves as mounting aid.

A further advantage of the embodiments described is that the terminal covering caps 8 and 32 can be mounted on both connection sides of a symmetrically formed electrical switching device.

We claim:

1. A terminal covering cap for electrical connection terminals of a multi-phase electrical switching device, comprising:

an insulating housing in which the electrical connection terminals for all phases are accommodated;

clamping screws which serve for fastening electrical lines in the connection terminals, which are perpendicular to the lines and which are accessible from the surface of the insulating housing via recesses provided in the housing, wherein:

an L-shaped terminal covering cap that ensures electric strength between connection terminals of neighbouring phases, the L-shaped terminal covering cap including:

a) a leg extending over said recesses leading to the clamping screws and a second leg extending over connection openings which are provided in the housing and which lead to the connection terminals, b) a side facing the insulation housing that closely abuts, with a negligible air gap, a marginal region of said connection openings of the housing, which lead to the connection terminals, and wherein the terminal covering cap is provided with cap openings leading to the connection terminals and with projecting ribs ensuring a required creep distance, said ribs being provided on the surface of the terminal covering cap facing away from the insulating housing and being provided between the cap openings leading to the connection terminals.

2. The terminal covering cap according to claim 1, wherein the terminal covering cap is undetachably mounted to the finished switching device by snap connections before the electrical lines are connected.

3. The terminal covering cap according to claim 1, further comprising at least one holding extension gripping behind in the insulating housing and at least one snap lug gripping behind a projection of the insulating housing.

4. The terminal covering cap according to claim 1, further comprising at least one holding stop and at least one snap lug, wherein the L-shaped terminal covering cap is screwed onto the insulating housing in a region of said housing recesses which lead to the connection terminals and is fastened by means of its leg that is perpendicular thereto to the insulating housing via at least one holding stop gripping behind the insulating housing and via of at least one snap lug engaging a projection of the insulating housing.

5. The terminal covering cap according to claim 1, further comprising separating extensions which protrude into the cavity of the housing recesses leading to the connection terminals of neighbouring phases.

6. A protected multi-phase electrical switching device, comprising:

an insulating housing carrying a plurality of electrical connection terminals disposed in connection openings formed in a first housing wall;

clamping members extending through a recess formed in a second housing wall that lead to at least one of the connection terminals, wherein the clamping members fasten electrical lines to the connection terminals;

a terminal covering cap including:

a first leg extending over said recesses;

a second leg extending over the connection openings, wherein said second leg presents a surface that faces the insulation housing in close proximity to a marginal region of the connection openings; and a plurality of ribs projecting outwardly away from the insulating housing, the covering cap defining a cap opening between adjacent ribs that leads to a connection terminal.

7. The electrical switching device as recited in claim 6, wherein the clamping members comprise clamping screws.

8. The electrical switching device as recited in claim 6, wherein the first and second legs extend substantially perpendicular to each other.

9. The electrical switching device as recited in claim 6, wherein the connection terminals extend substantially perpendicular to the lines.

10. The electrical switching device as recited in claim 6, wherein the terminal covering cap is undetachably mounted to the finished switching device via snap connections before the electrical lines are connected.

11. The electrical switching device as recited in claim 6, wherein the terminal covering cap further comprising extensions protruding into the recesses leading to connection terminals of neighbouring phases.

12. The electrical switching device as recited in claim 6, wherein the second leg is connected to the housing via at least one holding stop gripping behind the insulating housing and at least one snap lug engaging a projection of the insulating housing.

13. The electrical switching device as recited in claim 6, wherein the terminal covering cap is substantially L-shaped.

* * * * *